United States Patent [19]

Phatak

[11] Patent Number: 4,569,484

[45] Date of Patent: Feb. 11, 1986

[54] AIR BLAST TYPE COAL SLURRY FUEL INJECTOR

[75] Inventor: Ramkrishna G. Phatak, San Antonio, Tex.

[73] Assignee: The United States of America as represented by the United States Department of Energy, Washington, D.C.

[21] Appl. No.: 645,956

[22] Filed: Aug. 31, 1984

[51] Int. Cl.[4] ..... B05B 7/12

[52] U.S. Cl. ..... 239/410; 239/408; 239/412; 239/432; 239/533.3

[58] Field of Search ..... 239/86, 407, 408, 410, 239/412, 427, 429, 432, 533.6, 584, 533.1–533.12

[56] References Cited

U.S. PATENT DOCUMENTS

| | | | |
|---|---|---|---|
| 1,112,878 | 10/1914 | Wigelius | 239/407 |
| 1,157,273 | 10/1915 | Windeler | 239/408 |
| 1,157,305 | 10/1915 | Frost | 239/408 |
| 1,157,315 | 10/1915 | Lemp | 239/86 |
| 1,186,193 | 6/1916 | Hoffmann | 239/432 |
| 1,581,725 | 4/1926 | Egersdorfer | 239/432 |
| 1,615,457 | 1/1927 | Jorgensen | 239/408 |
| 1,625,606 | 4/1927 | Hildebrand | 239/408 |
| 1,762,611 | 6/1930 | Craigon | 239/432 |
| 2,772,117 | 11/1956 | Ritzau et al. | 239/432 |
| 3,806,041 | 4/1974 | Tolan | 239/533.6 |
| 4,335,684 | 6/1982 | Davis | 123/1 A |

*Primary Examiner*—Andres Kashnikow
*Assistant Examiner*—James R. Moon, Jr.
*Attorney, Agent, or Firm*—L. E. Carnahan; Roger S. Gaither; Judson R. Hightower

[57] ABSTRACT

A device to atomize and inject a coal slurry in the combustion chamber of an internal combustion engine, and which eliminates the use of a conventional fuel injection pump/nozzle. The injector involves the use of compressed air to atomize and inject the coal slurry and like fuels. In one embodiment, the breaking and atomization of the fuel is achieved with the help of perforated discs and compressed air. In another embodiment, a cone shaped aspirator is used to achieve the breaking and atomization of the fuel. The compressed air protects critical bearing areas of the injector.

20 Claims, 4 Drawing Figures

AIR BLAST TYPE COAL SLURRY FUEL INJECTOR

BACKGROUND OF THE INVENTION

The invention described herein arose in the course of, or under, Contract No. DE-AC19-82BC10730 awarded by the United States Department of Energy.

The invention relates to fuel injectors, particularly to coal slurry fuel injectors for internal combustion engines, and more particularly to an air blast type coal slurry fuel injector.

The rapidly increasing price of oil and uncertainty as to its availability has led to increased interest in the use of alternative fuels, such as coal. Fuels for internal combustion engines, such as diesel engines, have been investigated in which coal is substituted for all or a portion of the liquid petroleum fuel conventionally employed. By way of example, fuel mixtures of pulverized coal and air have been proposed for diesel engines, but such have generally been unsuccessful due to incomplete combustion and problems associated with introducing the fuel into the engine cylinders. Coal-oil slurries have also been investigated as diesel engine fuels, but in order to maintain suitable fluid viscosities for injection into the engine, the coal content must be limited, and thus the desired reduction in oil consumption could not be achieved.

Various types of fuel injectors are known in the art which utilize relatively heavy fuels admitted with air under high pressure. These prior known fuel injectors are exemplified by U.S. Pat. No. 1,157,305 issued Oct. 19, 1915 to W. H. Frost; U.S. Pat. No. 1,157,315 issued Oct. 19, 1915 to H. Lemp; U.S. Pat. No. 1,260,500 issued Mar. 26, 1918 to A. Winton; and U.S. Pat. No. 1,473,073 issued Nov. 6, 1923 to A. A. Asplund.

More recently, efforts have been directed to the use of a coal-water fuel slurry for reciprocating internal combustion engines, as exemplified by U.S. Pat. No. 4,335,684 issued June 22, 1982 to J. P. Davis. In that system the coal in the slurry was in the form of micronized particles which facilitated complete combustion of the coal, and the water in the fuel slurry served as a transport medium for the micronized coal.

A need has existed for a coal slurry fuel injector which is effective for breaking and atomization of the fuel to produce complete combustion of the fuel in an internal combustion engine.

SUMMARY OF THE INVENTION

The fuel injector of this invention fulfills the above-mentioned need by use of compressed air to atomize and inject coal slurry and like fuels in an internal combustion engine. The breaking and atomization of the slurry fuel is achieved with the help of perforated discs and compressed air or by a cone-shaped aspirator. The compressed air also protects the critical bearing areas of the injector. The invention eliminates the use of prior high pressure/precision fuel injection pump/nozzle arrangements and their associated costs.

More specifically, the invention involves an air blast type coal slurry fuel injector which comprises a body containing a needle valve sliding in a bushing and having a control spring at one end and adapted to open and close the fuel exit from the body at the other end, a mixing chamber behind the fuel exit containing perforated discs or a cone-shaped aspirator, and coal slurry and air passages discharging into the mixing chamber.

Breaking and atomization of the fuel in the mixing chamber is achieved with the help of the perforated discs, or an aspirator and compressed air.

Accordingly, it is an object of this invention to provide a coal slurry fuel injector for internal combustion engines.

A further object of the invention is to provide an air blast type coal slurry fuel injector for internal combustion engine.

Another object of the invention is to provide a coal slurry fuel injector which utilizes compressed air to achieve breaking and atomization of the fuel.

Another object of the invention is to provide a coal slurry fuel injector having a mixing chamber within which is located perforated discs or a cone-shaped aspirator to assist the compressed air in breaking and atomizing the fuel.

Other objects of the invention will become apparent to those skilled in the art from the following description and accompanying drawings.

DETAILED DESCRIPTION OF THE INVENTION

The present invention is directed to a coal slurry fuel injector for internal combustion engines, which utilizes compressed air to atomize and inject the coal slurry. Breaking and atomization of the fuel is achieved with the help of perforated discs or an aspirator and compressed air, the air also protecting critical bearing areas of the injector. The injector of this invention eliminates the cost associated with prior known high pressure/-precision fuel injection pump/nozzle arrangements, while providing an effective device for atomizing and injecting coal slurry into a combustion engine.

Figure 1:
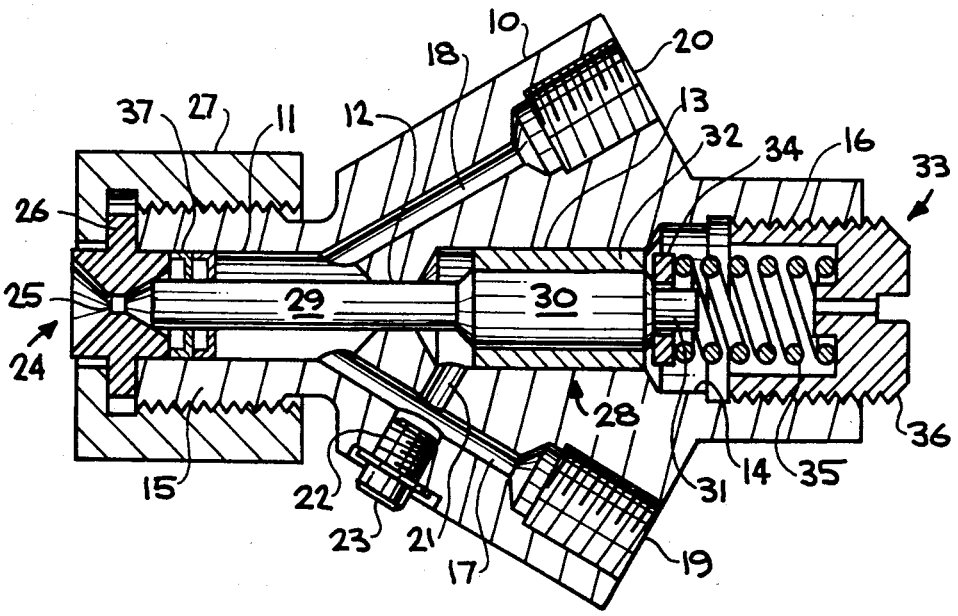
FIG. 1 illustrates an embodiment of the invention utilizing perforated discs in the mixing chamber.
Figure 4:
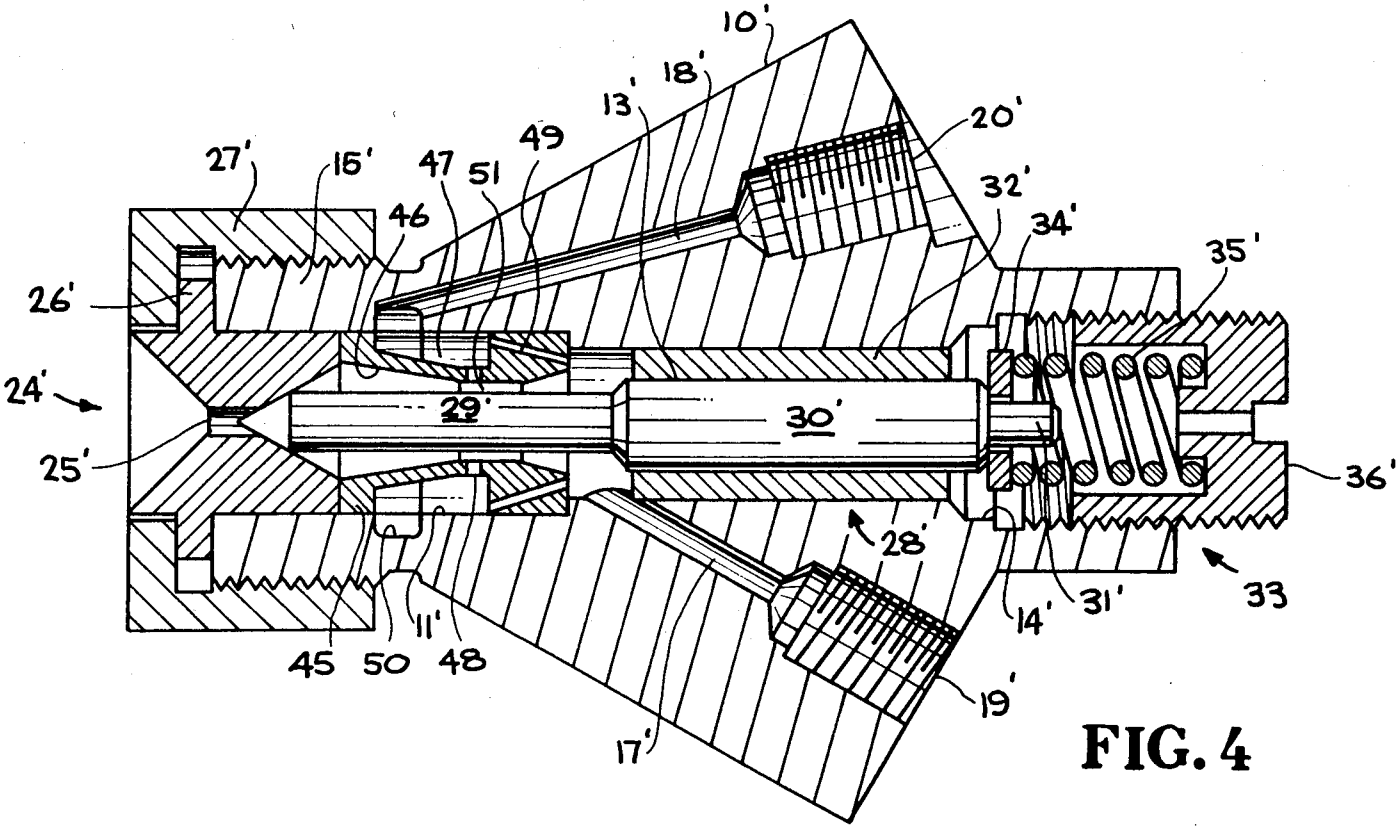
FIG. 4 illustrates another embodiment of the invention utilizing an aspirator located in the mixing chamber.

FIGS. 1 and 4 illustrate two similar but different embodiments of an air blast type coal slurry made in accordance with the invention. The FIG. 1 embodiment utilizes perforated discs in the mixing chamber, while the FIG. 4 embodiment utilizes a cone-shaped aspirator in the mixing chamber.

Referring now to the FIG. 1 embodiment, the fuel injector comprises: a housing 10 having a central opening extending therethrough defining four separate sections or chambers 11, 12, 13 and 14, an externally threaded end section 15, with opening section or chamber 14 being threaded as indicated at 16. Housing 10 is provided with a compressed air inlet or passage 17 and a fuel (coal slurry) inlet or passage 18, each of passages 17 and 18 are in communication at the inner end with the opening section or chamber 11 and are provided at the outer end with threaded sections 19 and 20, respectively, to which compressed air and fuel supply lines may be attached. An additional passage 21 is provided in housing 10 which interconnects air inlet or passage 17 with opening section or chamber 13, passage 21 being provided with a threaded outer section 22 into which is threaded a plug 23. The compressed air also serves to protect critical surfaces of the injector.

A nozzle assembly 24, having a converging-diverging opening 25 and a radially protruding section 26, is positioned in an outer end of opening section or chamber 11. Nozzle assembly 24 is secured in chamber 11 by a threaded collar or end piece 27 which is threaded onto end section 15 of housing 10 and retains the protruding section 26 of nozzle assembly 24 between end section 15 and collar 27.

Positioned in opening sections or chambers 11–14 is needle assembly 28 which includes three sections 29, 30 and 31 of different diameters. The larger diameter section 30 of the needle assembly 28, is mounted in a bushing 32 located in opening section or chamber 13. The intermediate diameter section 29 extends from chamber 13 through chamber 12 and into chamber 11 and terminates in buttment with the converging diverging opening 25 of nozzle assembly 24. The smaller diameter section 31 of needle assembly 28 extends into chamber 14 around which is positioned a control spring assembly 33. The control spring assembly 33 includes a ring or collar 34 located around needle assembly section 31 and in abutment with the larger section 30 of needle assembly 28, a spring 35 and a threaded plug or member 36 which is movably positioned in threaded section 16 of chamber 14. Thus, turning of the plug 36 further into chamber 14 causes an increase of pressure on spring 35 which in turn forces needle assembly 28 against nozzle assembly 24. Note that the outer end of section 29 of needle assembly 28 is cut off straight to provide a sealing surface with nozzle assembly 24.

Figure 2:
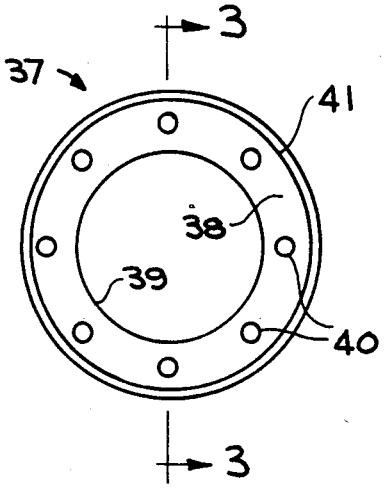
FIG. 2 is an enlarged view of a perforated disc of FIG. 1.
Figure 3:
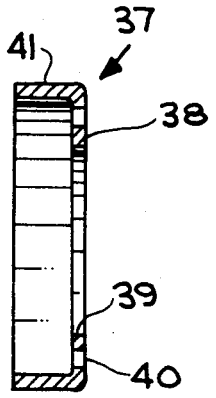
FIG. 3 is a view taken along the lines 3—3 of FIG. 2.

Positioned in chamber 11 of housing 10 are a plurality of perforated discs 37, only two being shown, which are positioned around needle assembly section 29. One of the discs 37 is illustrated in FIGS. 2 and 3 and comprises a body section 38 provided with central opening 39 and a plurality of perforations or openings 40, and a protruding annular flange section 41.

By way of example, the housing 10 may be constructed of steel, stainless steel, or alloy steel, the nozzle assembly 24 constructed of steel, stainless steel or alloy steel, the needle assembly 28 constructed of steel, stainless steel or alloy steel, with bushing 32 being bronze, cast iron or teflon, with collar or end piece 27 constructed of steel or stainless steel, control spring assembly 33 being constructed of carbon steel or stainless steel, and perforated discs 37 being of steel, stainless steel, or carbon steel. Also, by way of example, the opening sections or chambers 11, 12, 13 and 14, would have a diameter of 0.500", 0.250", 0.675", and 0.750", respectively, with sections 29, 30 and 31 of needle assembly 28 having diameters of 0.250", 0.375" and 0.125", respectively, with nozzle assembly 24 having an opening of 0.020" to 0.080" with the converging-diverging section tapering at an angle of 45° to 120°.

The slurry fuel injector of FIG. 1 functions to atomize and inject the fuel. This is accomplished as follows:

The slurry fuel is supplied to the injector at low pressure with the help of a suitable metering pump. By way of example, the slurry fuel supply pressure may be 10 pounds per square inch. The slurry fuel is supplied prior to the supply of high pressure air. By way of example, air may be supplied 10 milliseconds after the slurry fuel is supplied. The slurry fuel occupies the space surrounding part of the needle assembly section 29, and mainly above the perforated discs 37. The volume of air supplied is many times the volume of fuel. By way of example, the volume of fuel supplied is 400 cubic millimeters, whereas the volume of air supplied is 650 cubic centimeters. When the needle is lifted and the flow starts, the high pressure expands and flows through the small holes in the perforated discs, carrying a small amount of slurry fuel with it. Every hole in the perforated disc forms a highly turbulent jet of air and slurry fuel. Because of the large number of perforated discs, the air-slurry fuel mixture goes through several turbulent jets thereby atomizing the fuel prior to its exit from the nozzle body.

Reference is now made to the embodiment of FIG. 4, which differs from that of FIG. 1 primarily in the use of a cone-shaped aspirator instead of the perforated discs. Components corresponding to those of FIG. 1 will be given similar reference numerals.

Housing 10' is provided with a central opening having three different diameter sections forming chambers 11', 13' and 14' within which a needle assembly 28' is located, needle assembly 28' including different diameter sections 29', 30' and 31'. Section 30' of the needle assembly is mounted in a bushing 32' located in chamber 13', with the section 29' extending into chamber 11' and abutting a nozzle assembly 24', and section 31' extending into chamber 14' about which is mounted a control spring assembly 33, similar to the arrangement illustrated in the FIG. 1 embodiment. The nozzle assembly 24' is retained in chamber 11' by a threaded retaining collar or end piece 27' via connection to threaded end section 15' of housing 10, with the nozzle assembly including a converging-diverging opening 25' and radially extending flange 26'. The control spring assembly 33 is composed of a ring or collar 34', a spring 35' and a threaded plug 36' by which pressure is applied to needle assembly 28', as described in the FIG. 1 embodiment.

A cone-shaped aspirator assembly 45 is located in chamber 11' adjacent nozzle assembly 24' and surrounds part of needle assembly section 29', and consists of a body member having a cone shaped section 46 at one end (adjacent nozzle 24') an annular cut-away section which forms and an annular chamber 47, and a plurality of passages 48 and 49 extending from chamber 47 to the interior and rear end surfaces, respectively, of the body member. The body member of aspirator 45 may be constructed of steel, stainless steel or alloy steel. Housing 10' is provided with a fuel (coal slurry) inlet passage 18' which terminates at the inner end thereof in an annular groove 50 in housing 10' adjacent chamber 47 of aspirator assembly 45, passage 18' terminating at its outer end in a threaded section 20'. A compressed air inlet passage 17' extends through housing 10' and terminates at its inner end in communication with chamber 13' and at its outer end in a threaded section 19'. As described above, fuel and compressed air supplies are connected to threaded sections 20' and 19' of passages 18' and 17', respectively. As can be seen, fuel entering through passage 18' is directed through annular groove 50, annular chamber 47 and passages 48 and 49 where it is mixed with compressed air from passage 17' and directed through a space 51 between aspirator assembly 45 and needle assembly section 29' for passage through cone shaped section 46 into the converging-diverging opening 25' of nozzle assembly 24'. Passage of the fuel-air mixture through the nozzle assembly 24' is controlled by the movement of needle assembly section 29' with respect to nozzle assembly opening 25'. The movement of needle assembly 28' is controlled by the tension thereon applied by control spring assembly 33' and the offsetting compressed air and fuel pressure applied against the surface of the needle assembly 28' connecting sections 29' and 30' thereof.

By way of example, with chamber 11' having a diameter of 0.750" and chamber 13' having a diameter of 0.375", needle assembly sections 29' and 30' having respective diameters of 0.25" and 0.375", the annular chamber 47 of aspirator 45 has a depth of about 0.160" and length of 0.500" with passages 48 and 49 having a diameter of 0.032" and 0.032", respectively, and the space 51 having a clearance or radial distance of about 0.032" to 0.045" between needle section 29' and aspirator 45. Cone shaped section 46 of aspirator 45 has a taper at an angle of 10° to 30°, with the taper of the converging-diverging opening 24' being 30° to 130°.

With the fuel under a pressure of 5 to 50 psi, for example, and the air at a pressure of 400 to 1,000 psi, the atomizing of the fuel is accomplished as follows:

The slurry fuel is supplied to the injector at low pressure with the help of a suitable metering pump. By way of example, the slurry fuel supply pressure may be 10 pounds per square inch. The slurry fuel is supplied prior to the supply of high pressure air. By way of example, air may be supplied 10 milliseconds after the slurry fuel is supplied. The slurry fuel occupies the annuler space between the body 10, and the aspirator, 45. The volume of air supplied is many times the volume of fuel. By way of example, the volume of fuel supplied is 400 cubic millimeters, whereas the volume of air supplied is 650 cubic centimeters. When the needle is lifted and the flow starts, the high pressure air expands and flows through the cross section, 51, at a very high velocity. This high velocity air causes a pressure drop across the holes, 48, in cross section 51. Also, holes, 49, keep the slurry fuel at a pressure equal to the air supply pressure. The slurry fuel rushes out of the holes, 48, and mixes with the high velocity air. The high velocity turbulent air atomizes the fuel.

It has thus been shown, that the present invention provides an improved fuel injector, particularly applicable for coal slurry fuels, which eliminates the need of high pressure/precision fuel injection pump/nozzle systems and the associated costs thereof. The invention provides an effective device for atomizing and injecting a coal slurry into an internal combustion engine. Breaking and atomization of the fuel is achieved with the help of either perforated discs or a cone-shaped aspirator and the use of compressed air.

While particular embodiments of the invention have been illustrated and described, modifications will become apparent to those skilled in the art, and it is intended to cover in the appended claims all such modifications as come within the scope of the invention.

What is claimed is:

1. A fuel injector, particularly for injecting coal slurry fuel into an internal combustion engine, comprising:

a housing having a substantially central located opening extending therethrough, said opening having three different diameter sections;

a needle assembly located in said opening of said housing and including three different diameter sections with a larger diameter section thereof located between a smaller diameter section and an intermediate diameter section of the needle assembly;

a nozzle assembly having a converging-diverging opening positioned at least partially in a first of said different diameter sections of said opening of said housing, an outer end of said intermediate diameter section of said needle assembly cooperating with said converging-diverging opening of said nozzle assembly to form a sealing surface therebetween;

means for retaining said nozzle assembly in said opening of said housing;

means for applying pressure to said needle assembly, said pressure applying means being movably located in a second of said different diameter sections of said opening of said housing;

inlet means through which fuel and compressed air can be separately directed into said opening of said housing; and means located in said first of said different diameter sections of said opening of said housing and positioned around said intermediate diameter section of said needle assembly for breaking and atomizing fuel directed into and through said opening of said housing.

2. The fuel injector of claim 1, wherein said means for breaking and atomizing fuel consists of an aspirator.

3. The fuel injector of claim 2, wherein said aspirator consists of a body member having a central opening therein which includes at least one cone-shaped section, a cut-away section forming an annular chamber in an outer surface, a first plurality of passages extending from said chamber to said central opening, and a second plurality of passages extending from said chamber to an end surface of said body member.

4. The fuel injector of claim 3, wherein said housing is provided with an annular groove located adjacent to and in fluid communication with said first of said different diameter sections of said opening of said housing and adjacent to and in fluid communication with said annular chamber in said body member of said aspirator, said inlet means through which fuel is directed terminating adjacent to and in fluid communication with said annular groove, said inlet means through which compressed air is directed into said opening of said housing terminating in a third of said different diameter sections of said opening.

5. The fuel injector of claim 3, wherein said aspirator is located in substantial abutment-with said nozzle assembly, and wherein an outer diameter of said cone-shaped section of said aspirator is about equal to an outer diameter of a converging surface of said converging-diverging opening of said nozzle assembly.

6. The fuel injector of claim 1, wherein said means for applying pressure to said needle assembly is an adjustable spring biased assembly.

7. The fuel injector of claim 1, wherein said nozzle assembly also includes a radially extending section, and wherein said means for retaining said nozzle assembly comprises a threaded member adapted to cooperate with a threaded end section of said housing, whereby said radially extending section of said nozzle assembly is retained between said threaded member and said housing.

8. The fuel injector of claim 1, additionally including a bushing positioned around a larger of said different diameter sections of said needle assembly and located in one of said different diameter sections of said opening of said housing.

9. The fuel injector of claim 1, wherein said means for applying pressure to said needle assembly comprises a ring positioned around a smaller of said different diameter sections of said needle assembly and adapted to abut against a larger of said different diameter sections of said needle assembly, a movable threaded member positioned in a threaded surface of said second of said different diameter sections of said opening of said housing, and spring means positioned intermediate said ring and said threaded member.

10. A fuel injector, particularly for injecting coal slurry fuel into an internal combustion engine, comprising:

a housing having a substantially central located opening extending therethrough, said central opening having four different diameter sections, a smaller diameter section of which interconnects to larger diameter sections;

a needle assembly located in said central opening of said housing and including three different diameter sections, an intermediate diameter section of said needle assembly being positioned to extend through said smaller diameter section of said central opening and into said two larger diameter sections of said central opening, a largest diameter section of said needle assembly being located in one of said two larger diameter sections of said central opening, and a smallest diameter section of said needle assembly being located in a largest diameter section of said central opening;

a nozzle assembly having a converging-diverging opening positioned at least partially in one of said two larger diameter section of said cnetral opening of said housing, one end of said needle assembly cooperating with said converging-diverging opening of said nozzle assembly to form a sealing surface therebetween;

means for retaining said nozzle assembly in said central opening of said housing;

means for applying pressure to said needle assembly, said pressure applying means being movably located in said largest diameter section of said central opening of said housing;

inlet means through which fuel and compressed air can be separately directed into said central opening of said housing; and means located in said one of said two larger different diameter sections of said central opening of said housing for breaking and atomizing fuel directed into and through said central opening of said housing.

11. The fuel injector of claim 10, wherein said means for breaking and atomizing fuel consists of at least one perforated disc positioned around one of said three different sections of said needle assembly.

12. The fuel injector of claim 11, wherein said perforated disc comprises a body member having a central opening, a plurality of apertures located in spaced relation at a location radially outward from said central opening, and a flange member extending from the periphery thereof.

13. The fuel injector of claim 10, wherein said inlet means through which fuel and compressed air can be separately directed terminate adjacent one end of said one of said two large larger diameter sections of said central opening of said housing.

14. The fuel injector of claim 13 wherein said inlet means for directing compressed air includes a passage which terminates at a second of said two larger diameter sections of said central opening of said housing.

15. The fuel injector of claim 10, wherein said means for applying pressure to said needle assembly is an adjustable spring biased assembly.

16. The fuel injector of claim 10, wherein said nozzle assembly also includes a radially extending section, and wherein said means for retaining said nozzle assembly comprises a threaded member adapted to cooperate with a threaded end section of said housing, whereby said radially extending section of said nozzle assembly is retained between said threaded member and said housing.

17. The fuel injector of claim 10, additionally including a bushing positioned around said largest of said three different diameter sections of said needle assembly and located on one of said two larger diameter sections of said central opening of said housing.

18. The fuel injector of claim 10, wherein said means for applying pressure to said needle assembly comprises a ring positioned around said smallest of said three different diameter sections of said needle assembly and adapted to abut against said largest of said three different diameter sections of said needle assembly, a movable threaded member positioned in a threaded surface of said largest of said different diameter sections of said central opening of said housing, and spring means positioned intermediate said ring and said threaded member.

19. A fuel injector, particularly for injecting coal slurry fuel into an internal combustion engine, comprising:

a housing having a substantially central located opening extending therethrough, said central opening having three different diameter sections;

a needle assembly located in said central opening of said housing and including three different diameter sections with a larger diameter section thereof located between smaller and intermediate diameter sections thereof;

a nozzle assembly having a converging-diverging opening positioned at least partially in a first of said three different diameter sections of said central opening of said housing, one end of said needle assembly cooperating with said converging-diverging opening of said nozzle assembly to form a sealing surface therebetweem;

means for retaining said nozzle assembly in said central opening of said housing;

means for applying pressure to said needle assembly, said pressure applying means being movably located in a second of said three different diameter sections of said central opening of said housing;

a pair of inlet means through which fuel and compressed air can be separately directed into said central opening of said housing; and aspirator means located adjacent said nozzle assembly in said first of said three different diameter sections of said central opening of said housing, and positioned around said one end of said needle assembly, for breaking and atomizing fuel directed into and through said central opening of said housing;

said aspirator means consisting of a body member having a central opening therein which includes at least one cone-shaped section, a cutaway section forming an annual chamber in an outer surface, a first plurality of passages extending from said chamber to said central opening of said boby member, and a second plurality of passages extending from said chamber to an end surface of said body member, said annular chamber in said body member being in fluid communication with one of said pair of inlet means.

20. The fuel injector of claim 19, wherein said housing is provided with an annular groove located adjacent to and in fluid communication with said first of said three different diameter sections of said central opening of said housing and adjacent to and in fluid communication with said annular chamber in said body member of said aspirator, a first of said pair of inlet means through which fuel is directed terminates adjacent to and in fluid communication with said annular groove, a second of said pair of inlet means through which compressed air is directed into said central opening of said housing terminates in a third of said three different diameter sections of said central opening of said housing.

* * * * *